US007738826B2

(12) United States Patent
Montfort et al.

(10) Patent No.: US 7,738,826 B2
(45) Date of Patent: Jun. 15, 2010

(54) INTERLOCKING FASTENER DESIGN PREVENTS PART MOVEMENT

(75) Inventors: David B. Montfort, Webster, NY (US); John R. Falvo, Ontario, NY (US); Donald C. Koch, Webster, NY (US); Alex Talevski, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 467 days.

(21) Appl. No.: 11/904,255

(22) Filed: Sep. 26, 2007

(65) Prior Publication Data

US 2009/0080951 A1 Mar. 26, 2009

(51) Int. Cl.
*G03G 15/16* (2006.01)

(52) U.S. Cl. ..... 399/316; 29/521; 29/524.1; 29/525.06; 411/501

(58) Field of Classification Search ..... 399/297, 399/316, 350, 351; 411/501; 29/524.1, 525.06, 29/521

See application file for complete search history.

(56) References Cited

U.S. PATENT DOCUMENTS 4,779,326 A * 10/1988 Ichikawa ..... 29/520
2006/0137166 A1* 6/2006 Babej et al. ..... 29/509
2009/0294410 A1* 12/2009 Iwase et al. ..... 219/91.23

* cited by examiner

*Primary Examiner*—David M Gray
*Assistant Examiner*—Barnabas T Fekete
(74) *Attorney, Agent, or Firm*—James J. Ralabate

(57) ABSTRACT

When a TAB assembly is used in the transfer station of an electrostatic marking system, the blade used in the TABs becomes deformed or improperly aligned due to lateral movement of the clamp, held by rivets, which is used to maintain proper blade alignment. Provided herein is a simple, yet effective, way to secure this clamp with embedded burrs so that the useful life of the TAB is more than doubled over prior art TABs.

20 Claims, 6 Drawing Sheets

INTERLOCKING FASTENER DESIGN PREVENTS PART MOVEMENT

This invention relates to a riveted assembly and, more specifically, to a transfer assist blade useful in an electrophotographic marking system.

BACKGROUND

While the present invention of an interlocking rivet assembly can be effectively used in a plurality of different riveted configurations, it will be described for clarity as used in a transfer station of an electrostatic marking system such as electrophotography.

By the way of background, in marking systems such as electrophotography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to a final support material such as paper and the toner image is fixed thereto to form a permanent record corresponding to the original.

In these electrostatic marking systems, a photoreceptor belt or drum surface is generally arranged to move in an endless path through the various processing stations of the Xerographic process. Sometimes, as noted, the photoreceptor or photoconductor surface is in the form of an endless belt and in other systems it is in the form of a drum. In this endless path, several Xerographic-related stations are traversed by the photoconductive belt or drum, one of said stations being the transfer station where the toned image is transferred from the photoconductive surface to a final support media such as paper. Many of these marking systems utilize a transfer assist blade assembly (TAB) within the transfer station subsystem to provide unparalleled transfer performance with a wide variety of substrates. Examples of typical TAB assemblies are disclosed in U.S. Pat. Nos. 4,947,214; 5,568,238; and 6,687,480. The disclosures of these patents are incorporated by reference into the present disclosure. The TAB typically is composed of a multitude of parts accurately nested together to form a high precision structure that is used to provide pressure to the backside of a sheet towards the photoreceptor surface. When the blade is actuated against the paper the critical parameter for proper blade force (deletion free prints) and non-toner contaminated backside sheets is blade angle. The blade angle is controlled by the upper extrusion feature and the ability of the clamp to constrain the layers against this feature to maintain a 90 degree angle. The problem is that over time and actuation life (life is approximately 1.5 million cycles) the clamp moves away from the extrusion feature and the blade angle changes (increases). In one embodiment, the clamp is held against the extrusion by eight low profile (space constraint) rivets along its length. Though the rivets are very tight initially, the plastic blade laminate, squeezed between the clamp and the extrusion, creeps/relaxes over time and use, ultimately lowering the force exerted on the clamp. Hence, with reduced force the clamp more easily slips during operation. These rivets are generally made of a relatively soft material such as aluminum, plastic or other comparably soft composition. As these rivets loosen because of extensive continuous use of the transfer blade assembly (TAB), many problems occur that could easily cause imaging and performance problems in the entire marking system. A faulty TAB could scratch or mar the photoconductive surface, tear the paper-receiving sheets and contaminate the blade and future copies with loosened toner particles. Also poor toner transfer from the photoconductive surface to the paper could occur. As noted, a main cause of a faulty TAB is the loosened rivets caused by relaxation of the plastic blade material, cyclic vibration and the counter-reactive force of the TAB against the back of the paper supported by the photoconductive surface. These problems can occur in both color and monochromatic marking systems. Movement of this clamp is the basic problem attended to by the present embodiments.

SUMMARY

Embodiments herein provide an interlocking fastener design that prevents the lateral movement or "shear" of adjoining parts, such as the clamp relative to the extrusion. A mechanical interlocking feature, such as a projection or burr is blanked or formed on the interface surface of hole areas, in this case hole areas of the clamp. This harder projection(s), bites into the softer rivet underside and prevents eventual clamp movement. In this application, the rivet, by the nature of it expanding into the extrusion holes, in effect is made an extension of the substrate or extrusion. Adding the interlocking feature is accomplished with little to no extra cost and no additional parts or labor during assembly. The invention lends itself particularly well to riveting applications especially when space for additional parts is not available. A burr, projection or raised area is located adjacent to the entrance-hole area near the underside of the rivet cap. When the rivet is secured into the corresponding hole, the burr, projection or raised area bites into the underside of the head of the set rivet and prevents the clamp from later creeping or loosening. One or more burrs or raised projections may be used per rivet, any suitable number of burrs or raised projections may be needed to ensure non-movement of the clamp after extended usage of the TAB. Not all of the rivets in the TAB need to be secured by the burrs, only a suitable number sufficient to prevent lateral movement of the seated rivet is necessary. It is important that the length of the burr or projection be less than the thickness of the head of the rivet for reasons later addressed. It is important that the burr, projection or raised area (hereinafter "burr") be of a material substantially harder than the rivet. This is necessary for the burr to securely bite into the rivet or rivet head when the rivet is SET. In one embodiment, the rivet is composed of aluminum and the burr is composed of stainless steel. Obviously, any suitable burr and rivet material may be used provided the rivet is of a softer material than the raised burr and the burr is enabled to become embedded in the rivet. In an embodiment, several rivets 4-10 are used to clamp components of the TAB together, any suitable number of rivets and burrs may be used within the scope of this invention. The raised burrs provide an interlocking technique that solves the serious clamp lateral movement problems, together with the eventual blade failure of the prior art.

The TAB assembly is composed of a blade wear layer adhered to a Mylar® substrate and two Mylar® substrates adhered to a specifically engineered, low conductivity substrate. These essential components are preformed (bent to ~90 degrees) and accurately affixed to the machined substrate or extrusion via the use of a clamp and, in one embodiment, the clamp having eight interlocking burr features along its length to prevent relative movement between the clamp and the rivets. The major critical parameter as to the performance of this assembly is maintaining constant/stable force on the back side of paper during activation. The assembly when used in an electrostatic marking system activates (provides pressure) at the lead edge of the copy media or sheet and deactivates at the trail edge of the sheet in timing increments of a millisecond. In between sheets are process control patches comprised of toner for which the blade should never touch. Process control patches are used to provide a closed loop feedback to the print engine to enable consistent color rendition. If the clamp slips and the blade angles upward, the process control patch toner is smeared to the backside of the next sheet. Even though the assembly is clamped together in one embodiment in eight locations using the rivet manufacturer's most robust recommendations, the clamp in extended use would move "in shear" relative to the substrate or extrusion and subsequently angle the blade upward. Short of pinning or adhering the clamp in place, at a significant cost increase, another more suitable solution was necessary. This invention has provided this solution, i.e., an interlocking feature or burrs located on the clamp that when the rivet is seated, intentionally "bites" into the relatively soft aluminum rivet. Testing was performed comparing this approach against the nominal aluminum rivet and the vendor recommended steel rivet as to determine the permanent displacement of the clamp versus applied load. Both the aluminum and steel "rivet only" technique allows the clamp to move especially when the part is older, allowing time for the Mylar® laminates to creep/relax. However, the present invention with the interlocking burrs show in our testing no clamp movement. Life testing was conducted (about 2,000,000 print equivalent cycles) and no rivet creeping or movement is seen when comparing the time=0 feature measurements. In addition, engineering change try-out testing, performed on the system integration fleet of machines exhibited no TAB-related defects when having implemented this invention. Generally speaking in common usage, rivets are intended to hold objects together, not necessarily to prevent part-to-part "shear" movement. The novel approach given here is to intentionally create a directionally intent raised burr feature on the part adjacent the hole area to not allow lateral movement when gripped by a rivet and/or other fastener. Furthermore, for this particular application in electrostatic marking, any sharp features caused by exposure of the burrs need to be hidden (and low profile) to prevent electrical arcing from the adjacent high voltage (4 KV) corotron, otherwise print engine shutdown results.

Thus, the present embodiments provide a design to prevent clamp movement within the transfer assist blade (TAB) assembly. In one embodiment, the TAB consists of about 1-4 formed Mylar® strips clamped to a machined extrusion. There is a clamp that has in one embodiment about at least 1-8 rivets along its length. With an operational lifetime of approximately 1.5M cycles, this TAB assembly traverses against the backside of a sheet of paper beginning at the lead edge and continues until the trail edge to improve transfer. Over time, the clamp slips away from the upper extrusion feature, thereby no longer constraining the Mylar® strips, causing the blade to angle upwards. As earlier noted, this invention is able to eliminate this unwanted lateral movement through the use of a small raised burr stamped adjacent to or into each clamp hole area. This raised area bites into the softer rivet head and reduces the lateral motion of the clamp over the operational lifetime.

The blade in one embodiment is made from Mylar® (a trademark of DuPont Corporation) however, any suitable deformable material may be used, provided it does not damage the paper or substrate surface when in contact therewith.

DETAILED DISCUSSION OF DRAWINGS AND PREFERRED EMBODIMENTS

Figure 1A:
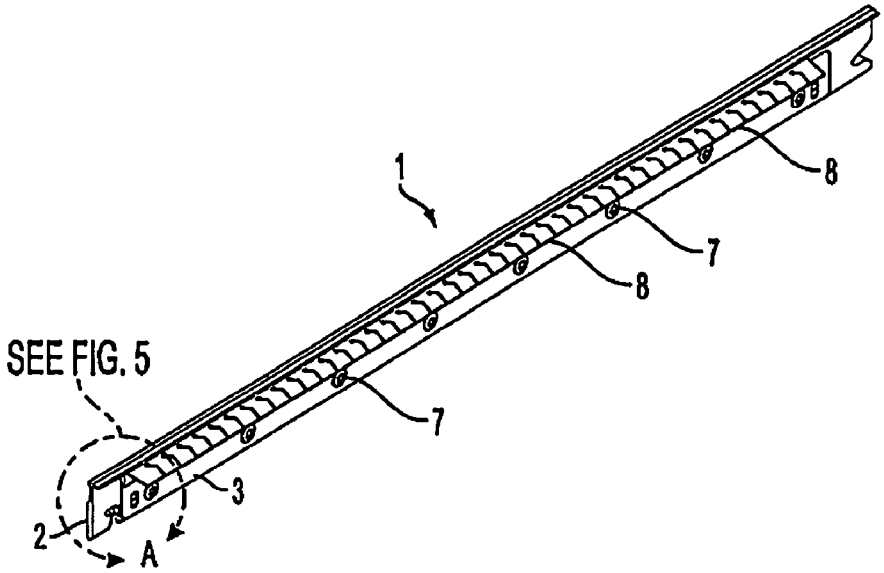
FIG. 1A is a front elevational view of an embodiment of a transfer assist blade assembly (TAB) of this invention.
Figure 1B:
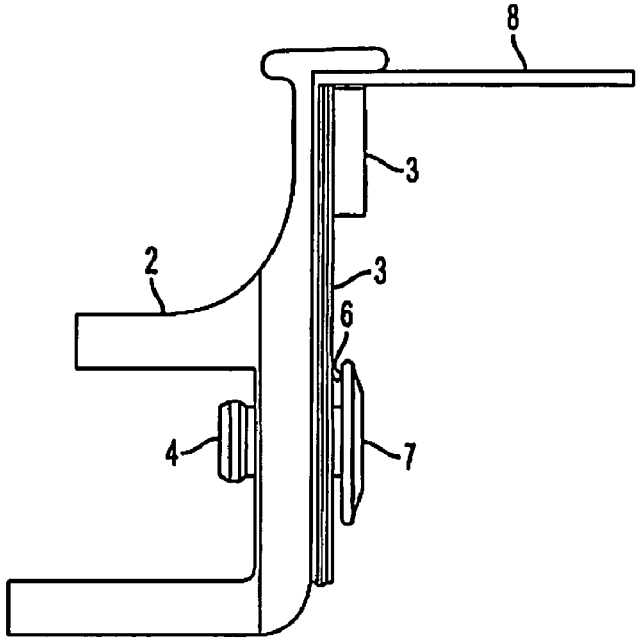
FIG. 1B is a side plan view of an embodiment of a TAB of this invention.
Figure 2:
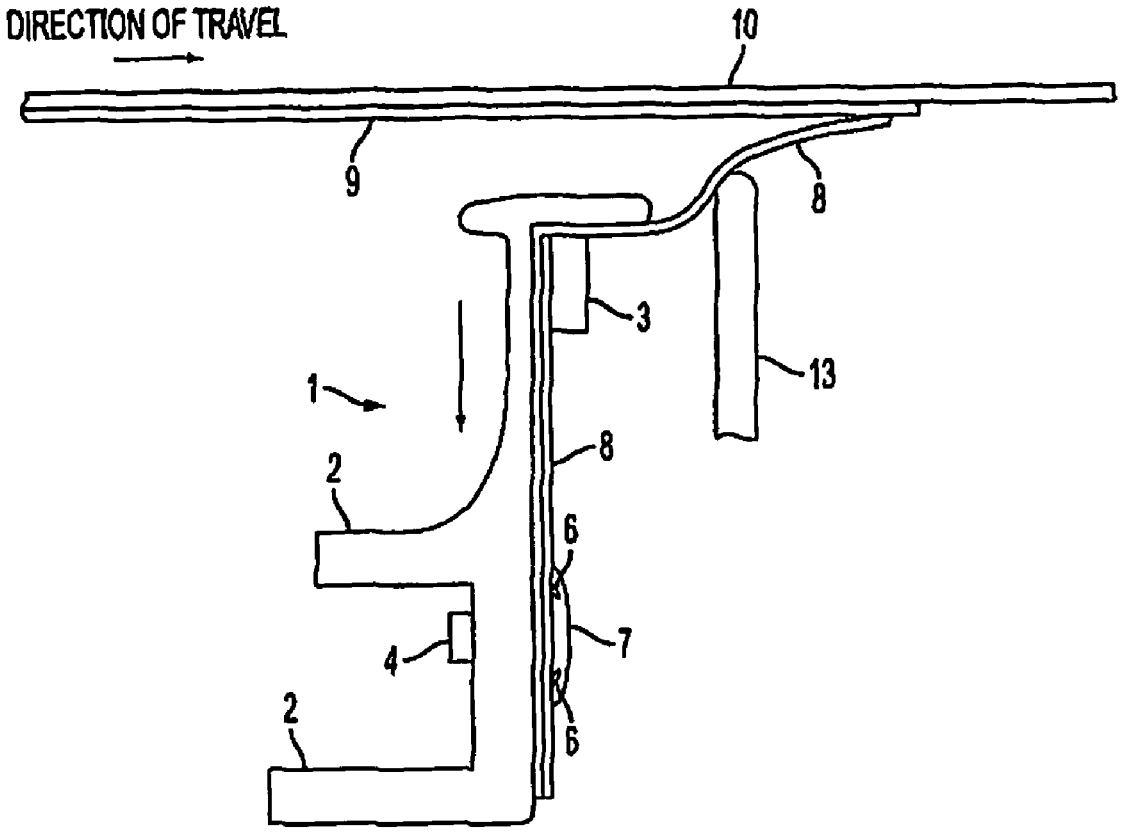
FIG. 2 is a plan side view of the TAB as it presses against a paper surface adjacent to a photoconductive layer.

In FIG. 1A an embodiment of the present invention is shown from a side view. A substrate or extrusion 2 is made from a sturdy material to provide strength to the TAB 1. A clamp 3 is affixed to the substrate 2 by rivets 4 and rivet heads 7 along its length. Eight rivets 4 are shown in the drawing of FIG. 1A; however, any suitable number of rivets may be used. Even though the TAB assembly 1 is clamped together in eight locations, the clamp 3 could move in shear relative to the extrusion or substrate 2 and subsequently angle the blade 8 upward. In the embodiments of FIGS. 1A and 1B an interlocking hard burr or feature 6 is placed on the clamp 3 that intentionally bites into the relatively soft rivet head 7 and securely holds the clamp 3 in place. In one embodiment the rivet/rivet head 4/7 is made from a softer material like aluminum and the raised burr 6 is made from steel; however, any suitable materials may be used provided the harder burr 6 is enabled to bite into the softer rivet head 7. In our testing using the burr 6 to secure the clamp 3 to the rivet/rivet head 4/7, no movement of the clamp 3 was present after up to 2 million runs. In addition, engineering change try-outs (ECTO) performed on a system integration fleet of marking apparatus using burrs 6 as described herein, has rendered no TAB related failures or effects due to clamp movement. Thus, the approach of this invention is to intentionally create a burr 6 that is enabled to be imbedded in the rivet to not allow lateral movement of the clamp 3 after extended continuous use of the TAB. Also, any sharp features of the burr 6 need to be hidden or not protruded in order to prevent in electrostatic marking systems electrical arcing from the adjacent high voltage corotron. This is accomplished by providing a burr or burrs 6 that are shorter than the thickness of the head or cap 7 of the rivet. See, for example, FIG. 4 herein. The Mylar blade 8 in this embodiment is secure after extended use and avoids the blade upward deformation of the prior art. Any suitable deformable material may be used as the blade 8 in place of Mylar, or together with Mylar. The burr or burrs 6 can be seen in FIG. 1B and FIG. 4 as they lock clamp 3 in place. One or more burrs may be used in embodiments of this invention, but for clarity in the drawings only one or two burrs 6 are shown. In FIG. 2, the TAB of this invention is shown in an electrostatic marking system as it applies pressure on the backside of image receiving paper or media 9 to provide good transfer of any imaged toner (not shown) from the photoconductive layer 10 to the paper 9 inner surface. After extensive use of the TAB in the prior art, the blade or Mylar strips become deformed, due to the clamp slippage and render the total imaging process faulty. In FIG. 2 a graphic is illustrated showing TAB/assembly activated against sheet 9. Assembly 1 translates downward, causing compliant blade layers 8 to cantilever over lifter bar 13, thereby biasing tip of blade 8 against paper 9 towards photoreceptor layer 10.

Figure 3:
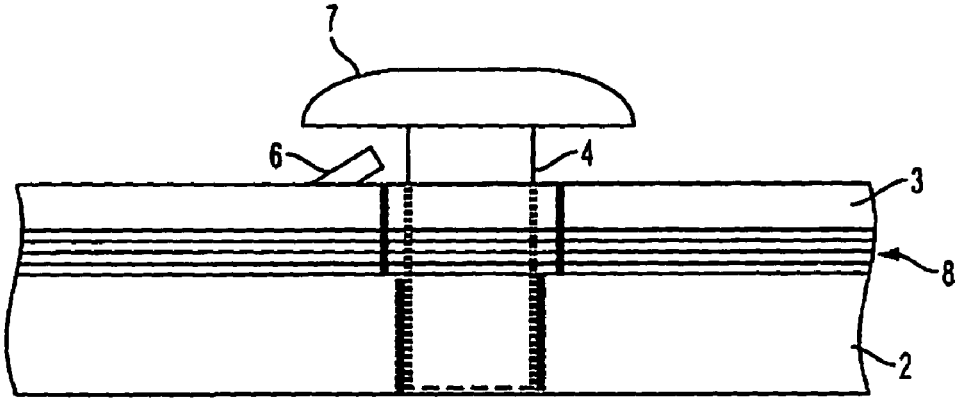
FIG. 3 is a side view of a rivet in the TAB before it is set and an upwardly extending burr before it is embedded into the rivet.

In FIG. 3 the rivet 4 is shown before it is seated into rivet hole 11 in clamp 3. The rivet head 7 must be wider and thicker than the length of burr or projection 6 to prevent burr 6 from protruding from the rivet head 7 when the rivet head 7 is seated. This is important in electrostatic marking systems to prevent electrical arcing from the adjacent high voltage corotron, otherwise there is a high probability that the print engine of the electrophotographic process will shut down. Only one projection or burr 6 is shown by way of illustration and not limitation, since as earlier stated, any number of burrs 6 may be used, if suitable.

Figure 4:
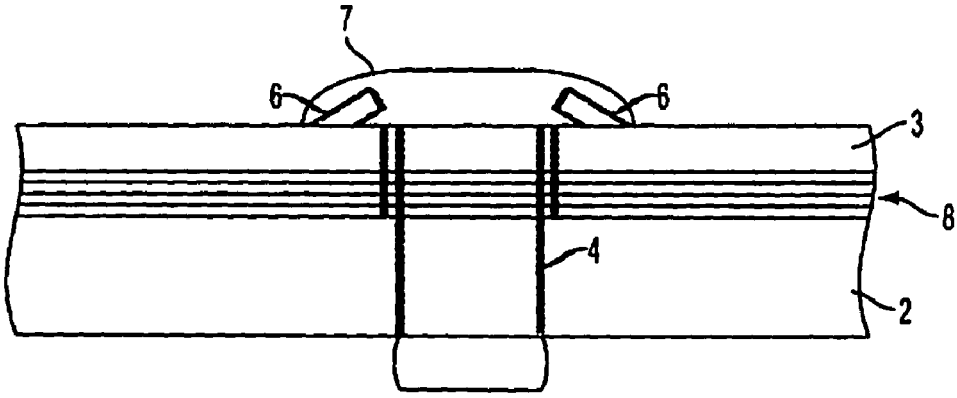
FIG. 4 is a side view of a rivet as it is set into a clamp as two burrs are embedded into the rivet.

In FIG. 4 the rivet 4 is shown seated into clamp 3 with burrs 6 embedded therein to securely hold the clamp 3 in place for extended use. Note that burrs 6 do not extend out of the rivet head 7, which is important to proper electrical usage. One or two or more burrs 6 may be used, if suitable. The rivet 4 secures clamp 3 and blade layers 8 to substrate 2.

Figure 5:
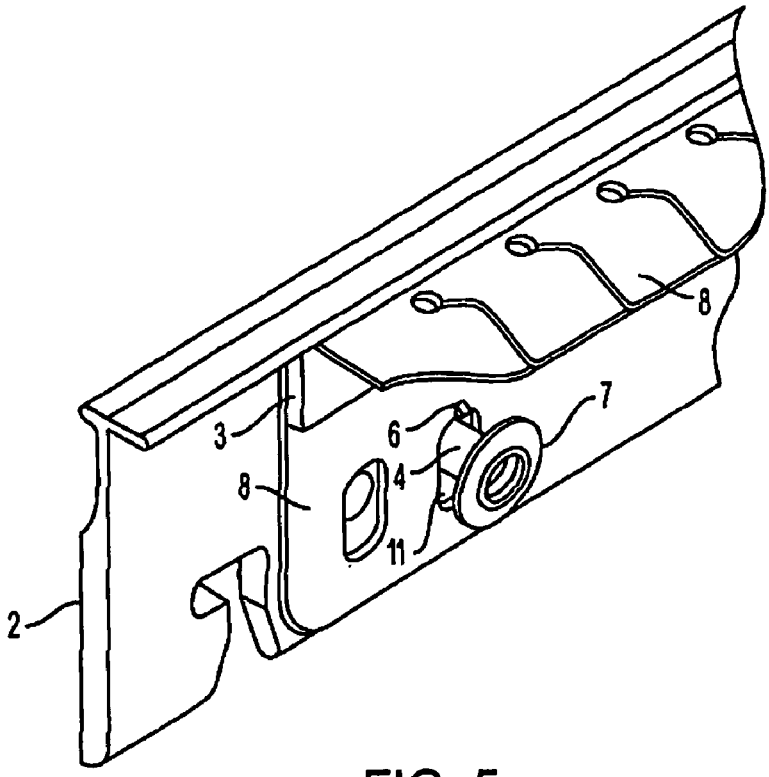
FIG. 5 is a front perspective enlarged view of circle-c of FIG. 1A except before the rivet is locked in place.
Figure 6:
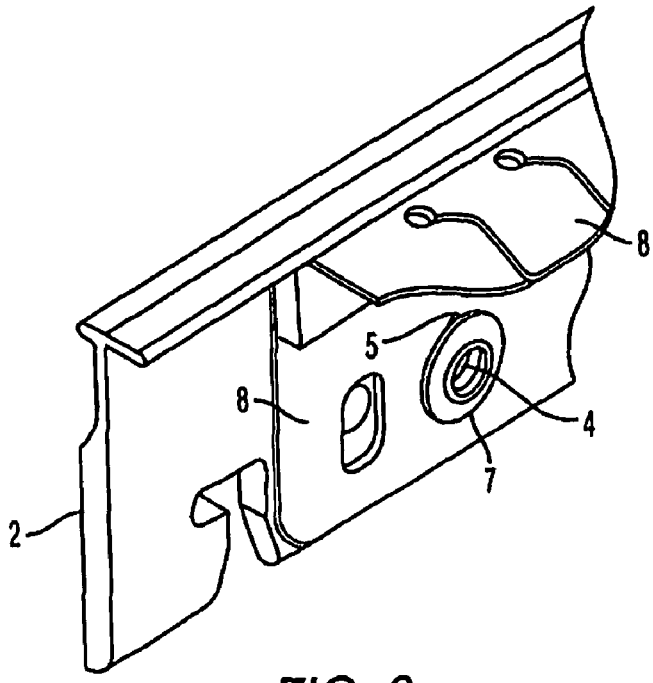
FIG. 6 is a front perspective enlarged view of circle-c of FIG. 1A when the rivet is fully engaged.

In FIG. 5 an enlarged view of area circle-c of FIG. 1A is shown except in FIG. 5 the rivet 4 is not locked in place. Clamp 3 is shown ready to be attached to substrate 2, clamping blade 8 in place. Rivet 4 is shown as it enters rivet hole 11 before being locked or set in place. Raised locking burr 6 is shown adjacent hole 11 ready to become embedded in rivet head 7 once the rivet 4 is locked in place. While only one burr 6 is shown, any suitable number of burrs 6 may be used in embodiments of this invention. Blade 8 is fixed at a ninety-degree angle once the rivets are locked in place with burrs 6 as shown in FIG. 6. An intentional interference 5 occurs between the rivet head 7 and locking burr 6 when the rivet is fully engaged.

Figure 7:
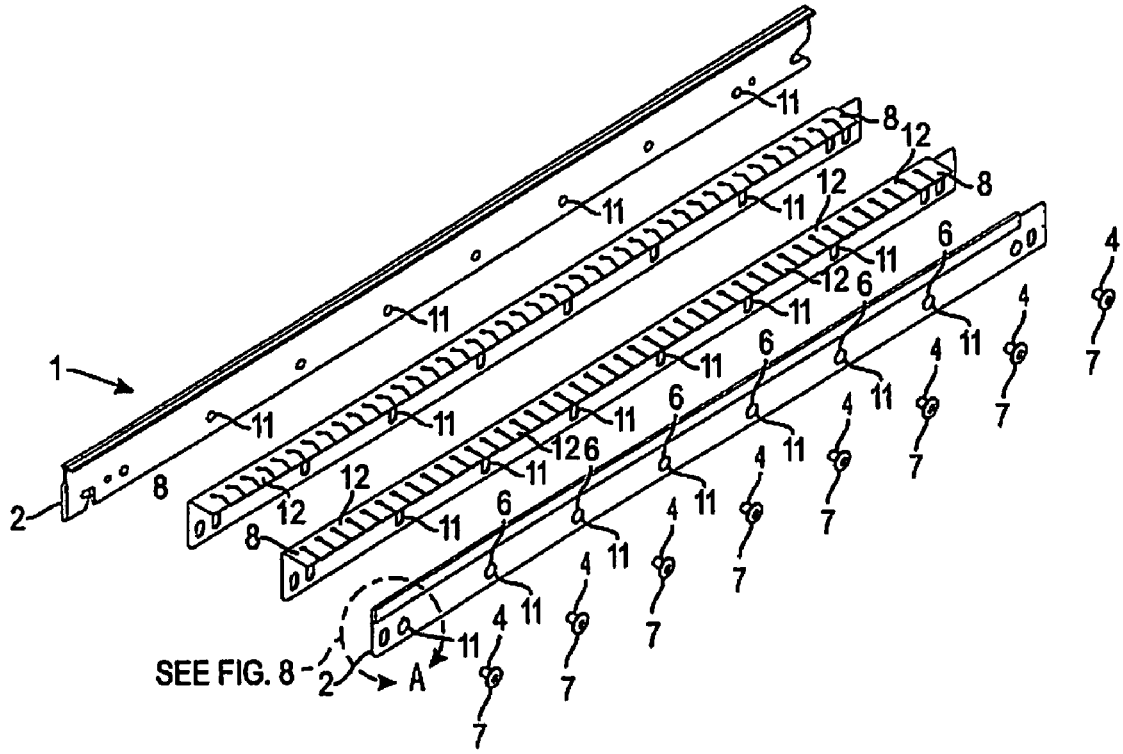
FIG. 7 is an exploded side view of an embodiment of the TAB of this invention.
Figure 8:
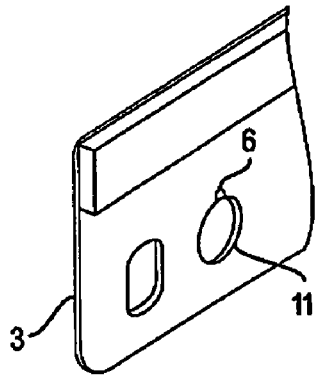
FIG. 8 is an enlarged view of circle A of FIG. 7.

FIG. 7 is an exploded side view of the components of an embodiment of this invention. A TAB blade holder or substrate 2 is shown having a plurality of rivet holes 11 extending along its length. Next deformable or conformable blades 8 with segmented blade portions 12 is shown; these portions 12 will accommodate pressure on various widths or sizes of paper 9 as shown in FIG. 2. Then clamp 3 is adapted to be pressed against blades 8 and align its holes 11 with the holes 11 of the blade 8 and substrate 2. Clamp 3 has holes 11 with raised burrs 6 adjacent to said holes 11. These raised burrs 6 can be seen in enlarged view of FIG. 8. FIG. 8 shows an enlarged view of portion circle-A of FIG. 7.

Figure 9:
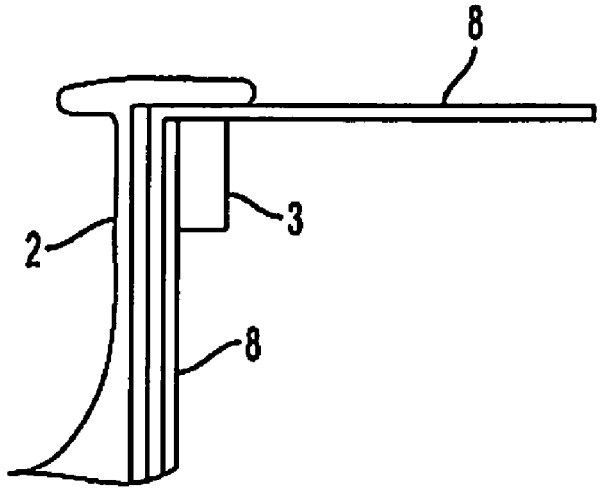
FIG. 9 is a side plan view of a TAB embodiment of this invention.

In FIG. 9 a side plan view of the TAB 1 assembly is shown after the rivets 4 (as shown in FIGS. 1B and 6) are set into clamp 3. Note that blade 8 remains at approximately a ninety degree angle so that it can apply proper pressure against paper 9 as shown in FIG. 2. Thus, the TAB assembly 1 is shown with clamp 3 properly constraining blade 8 against the upper extension of substrate 2, maintaining after extended use the proper 90 degree angle.

Figure 10:
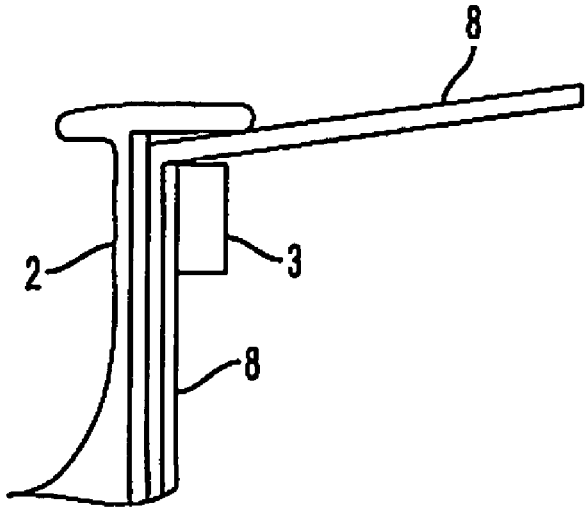
FIG. 10 PRIOR ART
FIG. 10 is a side plan view of a prior art TAB, illustrating a slipped clamp condition and subsequent improper blade angle.

In FIG. 10, the TAB assembly of the prior art is shown with clamp 3 having slipped away from the substrate 2 and no longer maintaining the proper 90 degree blade angle. This slippage is caused by the movement of clamp 3 without the use of raised locking burrs 6 of this invention.

Objective: Two different types of tests were performed to determine the effectivity of the present invention.

One test was a simple life test, where the assembly 1 is cycled in a manner to emulate actual operating conditions. At periodic cyclic intervals, a dimension is measured between the extrusion 2 and the clamp 3, to indicate any permanent clamp 3 movement as a result of cycling. The measurements were made at both the inboard and outboard positions of the assembly 1.

The other test involved applying a pull force to the clamp 3, in the direction of operational failure, while the extrusion 2 was held in place. The pull force was incrementally increased in 0.5 lb intervals up to 10.0 lbs. After each pull the permanent movement of the clamp 3 was measured. The measurements were made at both the inboard and outboard positions.

Test Results: When performing the life tests on prior art nominal configuration, the clamp slipped significantly between T=0 cycles and the first test interval, T=200,000 cycles. For the interlocking design prototypes of this invention using burrs 6, of which about seven have been tested, no slippage was measured out to life (1.7 million cycles).

For the pull test, our prior art configuration slipped at each test point, increasing in degree exponentially with increasing load. For the interlocking design prototypes (of this invention using burrs 6 to lock rivets in place), of which about thirteen have been tested, no slippage at all was measured up to the maximum 10.0 lb. load.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A transfer assist blade assembly (TAB) useful in a transfer station of an electrostatic marking system, said assembly comprising in an operative arrangement a blade with deformable or conformable strip, a substrate and a clamp, said blade movably or flexibly attached to said clamp, said clamp attached to said substrate by a plurality of rivets and said clamp having rivet hole areas therein, at least two hole areas having adjacent thereto raised burrs or projections that are enabled to bite into and securely lock said clamp in place when rivets are set in holes of said rivet hole areas, said burrs or projections having a length less than a thickness of a head on said rivets.

2. The assembly of claim 1 wherein said raised burrs are constructed of a harder material than said rivets, thereby enabled to become embedded into said head of said rivets when said rivets are set in said rivet holes of said rivet hole area.

3. The assembly of claim 1 wherein said burrs or projections are enabled to bite into a softer rivet and enabled to reduce a lateral motion of said clamp over an operational lifetime of said assembly.

4. The assembly of claim 1 wherein at least two or more rivets in said assembly are enabled to be secured in place by said burrs.

5. The assembly of claim 1 wherein there are from 3-10 rivets and rivet hole areas in said clamp.

6. The assembly of claim 1 wherein there are at least an equal number of said raised projections or burrs as there are rivets and rivet hole areas in said assembly.

7. The assembly of claim 1 wherein there are one or more raised burrs adjacent every rivet hole area.

8. The assembly of claim 1 wherein said deformable or conformable strips are constructed of a member selected from the group consisting of Mylar, rubber, elastomers and mixtures thereof.

9. The assembly of claim 1 wherein said rivets are constructed of aluminum and said raised burrs are constructed of steel.

10. The assembly of claim 1 wherein said assembly when used in an electrostatic marking system is enabled to contact a back side of a paper sheet when said sheet is adjacent to a toned photoconductive surface, said assembly enabled to exert pressure on said paper back side to enhance transfer of toner from said photoconductive layer to said paper.

11. A transfer assist blade assembly (TAB) useful in a transfer station of an electrostatic marking system, said assembly comprising in an operative arrangement a blade with deformable or conformable strips, a substrate and a clamp, said blade movably attached to said clamp, said clamp attached to said substrate by a plurality of rivets with rivet heads and having rivet hole areas and holes in said clamp, at least two of said rivet hole areas comprising adjacent a rivet entrance portion of said hole at least one raised burr, said burrs enabled to become embedded into said rivet and said rivet head when said rivet is set in said hole, said burrs enabled to substantially prevent lateral movement of said clamp during extended use of said assembly, said burrs having a length substantially less than a thickness of said rivet head.

12. The assembly of claim 11 wherein said strips are segmented along the blade length and are enabled to accommodate various size sheets.

13. The assembly of claim 11 wherein said raised burrs are constructed of a harder material than said rivets.

14. The assembly of claim 11 wherein there are at least three rivets used together with said holes and said rivet hole areas.

15. The assembly of claim 11 wherein there are from 3-10 rivets and rivet hole areas in said clamp, each of said areas having at least one of said burrs adjacent thereto.

16. The assembly of claim 11 wherein there are at least an equal number of said raised burrs as there are rivets and rivet hole areas.

17. The assembly of claim 11 wherein there are at least one raised burr for two or more rivet hole areas.

18. The assembly of claim 11 wherein said strips are constructed of a member selected from the group consisting of Mylar, rubber, elastomers and mixtures thereof.

19. The assembly of claim 11 wherein said rivets are constructed of aluminum and said raised burrs are constructed of steel.

20. The assembly of claim 11 wherein said assembly is enabled when used in an electrostatic marking system to contact a back side of a paper sheet when said sheet is adjacent to a toned photoconductive surface, said assembly enabled to exert sufficient pressure on said paper back side to enhance transfer of toner from said photoconductive layer to said paper, said assembly enabled to substantially reduce deformation of said blade caused by lateral movement of said clamp on said blade during extended use of said assembly.

* * * * *